US008733163B2

(12) United States Patent
Pelletier et al.

(10) Patent No.: US 8,733,163 B2
(45) Date of Patent: May 27, 2014

(54) FORMATION EVALUATION PROBE SET QUALITY AND DATA ACQUISITION METHOD

(75) Inventors: Michael T. Pelletier, Houston, TX (US); Abbas Sami Eyuboglu, Conroe, TX (US); Calvin Kessler, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/700,852

(22) PCT Filed: Jun. 9, 2010

(86) PCT No.: PCT/US2010/037978

§ 371 (c)(1),
(2), (4) Date: Mar. 8, 2013

(87) PCT Pub. No.: WO2011/155932

PCT Pub. Date: Dec. 15, 2011

(65) Prior Publication Data

US 2013/0192359 A1 Aug. 1, 2013

(51) Int. Cl.
*E21B 49/00* (2006.01)

(52) U.S. Cl.
USPC ..... 73/152.16; 73/152.18; 73/152.26; 166/179; 166/188

(58) Field of Classification Search
CPC ..... E21B 47/101
USPC ..... 73/152.18, 152.26, 152.16; 166/100, 166/101, 105, 250.1
See application file for complete search history.

(56) References Cited

U.S. PATENT DOCUMENTS

| | | | | |
|---|---|---|---|---|
| 5,353,637 | A * | 10/1994 | Plumb et al. | 166/250.1 |
| 5,521,882 | A | 5/1996 | D'Angelo et al. | |
| 6,513,591 | B1 * | 2/2003 | Heijnen | 166/250.08 |
| 6,758,090 | B2 * | 7/2004 | Bostrom et al. | 73/152.58 |
| 2005/0022987 | A1 * | 2/2005 | Green et al. | 166/250.17 |
| 2007/0151727 | A1 * | 7/2007 | Tao et al. | 166/250.1 |
| 2008/0115574 | A1 | 5/2008 | Meek | |

FOREIGN PATENT DOCUMENTS

| | | | |
|---|---|---|---|
| WO | WO 2005086699 | A2 * | 9/2005 |
| WO | WO-2011155932 | A1 | 12/2011 |

OTHER PUBLICATIONS

"International Application Serial No. PCT/US2010/037978, International Preliminary Report on Patentability mailed Jun. 22, 2012", 16 pgs.
"International Application Serial No. PCT/US2010/37978, International Search Report mailed Aug. 10, 2010", 4 pgs.
"International Application Serial No. PCT/US2010/37978, Written Opinion mailed Aug. 10, 2010", 10 pgs.

* cited by examiner

*Primary Examiner* — Lisa Caputo
*Assistant Examiner* — Roger Hernandez-Prewitt
(74) *Attorney, Agent, or Firm* — Schwegman, Lundberg & Woessner, P.A.; Benjamin Fite

(57) ABSTRACT

In some embodiments, an apparatus and a system, as well as a method an article, may operate to move a borehole seal in space with respect to the wall of a borehole while monitoring borehole seal contact quality data, which may comprise borehole seal contact pressure data and acoustic data. Operations may further include adjusting the movement of the borehole seal based on the borehole seal contact quality data. Additional apparatus, systems, and methods are disclosed.

28 Claims, 7 Drawing Sheets

FORMATION EVALUATION PROBE SET QUALITY AND DATA ACQUISITION METHOD

RELATED APPLICATIONS

This application is a U.S. National Stage Filing under 35 U.S.C. 371 from International Application No. PCT/US2010/037978, filed on Jun. 9, 2010, and published as WO 2011/155932 A1 on Dec. 15, 2011, which application and publication are incorporated herein by reference in their entirety.

BACKGROUND

Sampling programs are often conducted in the oil field to reduce risk. For example, the more closely that a given sample of formation fluid represents actual conditions in the formation being studied, the lower the risk of inducing error during further analysis of the sample. This being the case, downhole samples are usually preferred over surface samples, due to errors which accumulate during separation at the well site, remixing in the lab, and the differences in measuring instruments and techniques used to mix the fluids to a composition that represents the original reservoir fluid. However, downhole sampling can also be costly in terms of time and money, such as when sampling time is increased because sampling efficiency is low.

DETAILED DESCRIPTION

Figure 1:
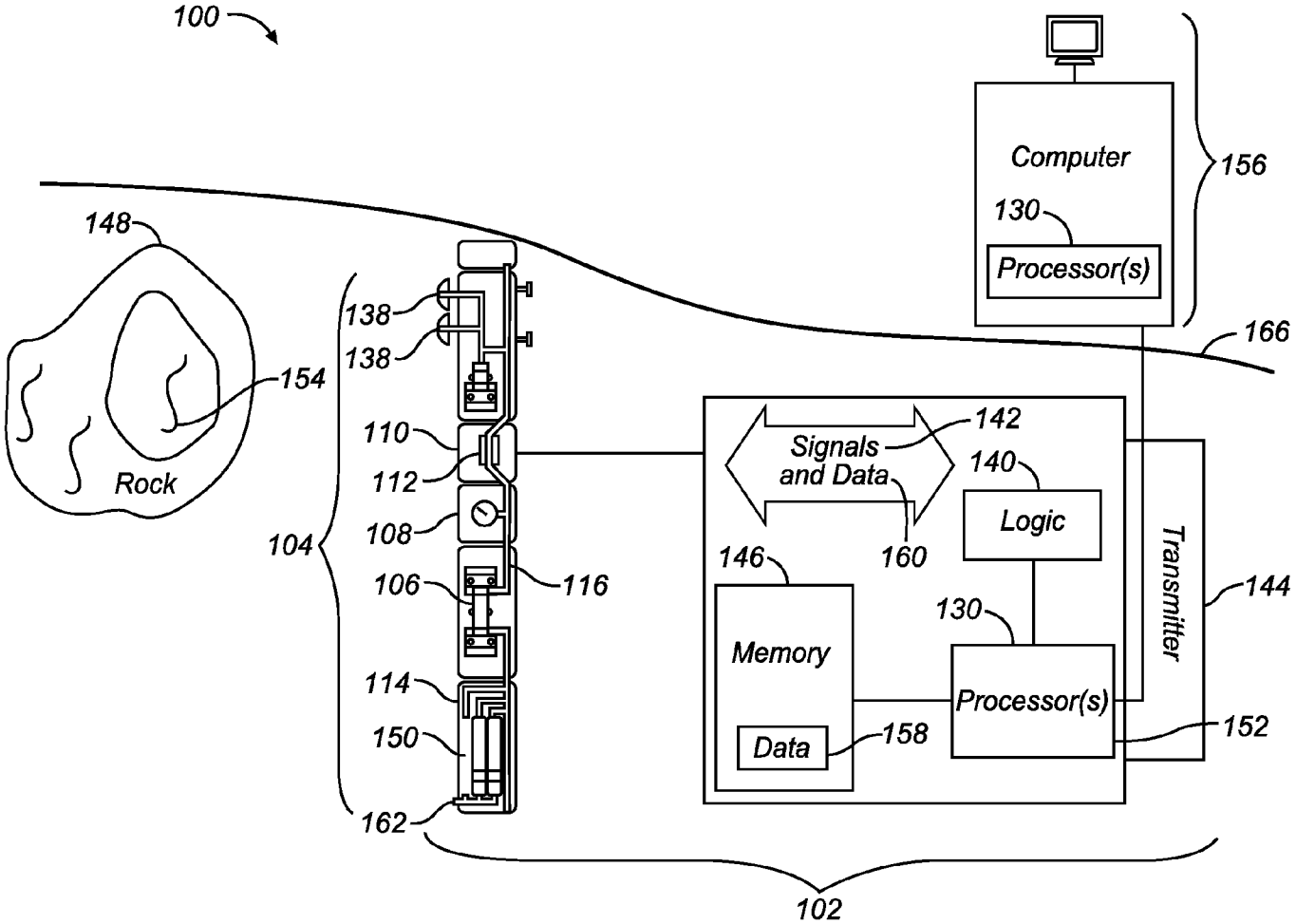
FIG. 1 is a block diagram of an apparatus and system according to various embodiments of the invention.

Various embodiments of the invention can be used to monitor the acoustic signature of a borehole seal (e.g., a pad, a packer, or a downhole fluid sampling probe seal) during sealing and fluid sampling activities. Other environmental data can be monitored as well. For example, the acoustic properties of a seal can be used to detect the seal contact quality of pad-type formation evaluation sampling tools as the pads are set, to qualify the operation and detect leakage or changes in conditions during fluid sampling operations, and to measure a compression modulus/index for each pad set. In the event of a detected failure, rock mechanical properties can be estimated, and the attempted reset of the pad can be qualified.

The detection of an incipient failure in the seal can be used to feed a control algorithm driving a pad/packer setting process. Monitoring of the inlet pressure to the tool is possible, as is the monitoring the hydraulic set pressure of a probe that is surrounded by the seal. These data components can also provide a signal to control the setting of a formation evaluation probe that depends on the formation strength. The initial settling of the probe can also be used to give some measure of wall smoothness, which can serve as an inverse predictor of difficulties in running the completion.

In setting a formation evaluation tool to evaluate a formation, pads or packers are driven out to touch the formation and then sealed by increasing pressure against the formation. Additional pressure and is applied to prevent leakage of the bore hole fluids into an isolated volume of the well bore that is created near the center of the pad, or between the packers. The pressure within this isolated volume of the well bore is then reduced, which in turn induces fluids to flow from the formation, through the mud cake on the wall of the well bore, and into the formation evaluation tool. Occasionally, the seal may be lost between the pad/packers and the well bore surface, allowing mud to flow into the measurement volume. This incursion of mud may nullify any advantage gained by isolating the test volume within the well bore. The situations is usually remedied, if caught early, by increasing the forces setting the sealing surfaces, or pulling the tool off the wall and then initiating a new setting sequence. The resetting process is costly in terms of time and equipment wear.

In some embodiments, the acoustic signature of the probe is monitored: during the setting process, and afterward. The monitoring may be accomplished using a force or pressure membrane under the pad, and/or a passive acoustic probe located in the hydraulics behind the probe, or perhaps using a wafer/point sensor under the formation sealing pad. With the addition of a probe displacement measurement (actual or synthetic), hydraulic setting pressure data can be converted into a rock hardness index which is in turn used to predict the success of probe sets, as well as hole stability during completion and production. In some embodiments, the seal contact quality monitoring and seal location adjustment sequence might be implemented as follows.

First, the (hydraulic, or electric) drive noise involved in extending the pad to the wall of the formation can be used to build an acoustic baseline. Then the initial contact with the mud cake can be recorded as a low amplitude event (e.g., a "squish" sound). This might be followed by a detectable series of sounds that are made as the pad partially seals and well bore surface irregularities are crushed, eliciting intermittent squeaks, groans and pops as the seal face settles onto the wall.

Once the there is a hard seal, the pressure is further increased to generate rock mechanics data; pressure on the seal is increased until a sudden release in support, perhaps indicating rock failure, is indicated. The fluid sampling can be extended, and the probe extension force measured (as is well known to those of ordinary skill in the art) so that an indentation hardness or index for the formation can be calculated.

After pressure within the isolated (sealed) volume is reduced, and during the fluid pumping phase, the acoustic environment proximate to the seal will include pumping sounds and hydrodynamic sounds provided by movement of the reservoir fluids. Some sounds of interest include cavitation (e.g., pumping the fluid with enough drawdown pressure to induce a change in phase behavior), and high-amplitude, pulse-modulated frequency bursts characteristic of pad seal failure. There may also be some amount of whistling due to fluid flow in porous media. Additional parameters of interest with respect to the fluid flow may include formation pore throat size, fluid compressibility, fluid viscosity, and fluid flow rate.

In several embodiments, single phase fluid flow exhibits sonic behavior with a relatively low level of dynamics, whereas multiphase flow will exhibit a modulated set of pulses due to the intermittent flow of gas and liquid. Changes in composition of the fluid will change the speed of sound in the fluid, revising the acoustic signature of the system. Thus, observing a more constant acoustic tone, versus a modulated tone, along with the desired fluid flow dynamics may serve to indicate that a satisfactory seal quality is being maintained.

As is known by those of ordinary skill in the art, load versus displacement curves taken from earth stability testing show that when the compression modulus is calculated along the linear portion of the curve, a rapid change in the slope indicates a shift from elastic to plastic deformation in front of the probe. This shift may be accompanied by a loss in permeability due to crushing. As the differential hydrostatic to formation pressure of an operating sealing pad further increases, higher pad loading is applied to maintain a secure seal, which in turn increases the possibility of the formation failing (e.g., by creeping away from a functional seal); creep of the formation becomes more likely in soft and unconsolidated formations. As pressures are still further increased, catastrophic failure occurs.

FIG. 1 is a block diagram of an apparatus 102 and system 100 according to various embodiments of the invention. The apparatus 102 may comprise a downhole tool 104 (e.g., a pumped formation evaluation tool) that includes a pressure measurement device 108 (e.g., pressure gauge, pressure transducer, strain gauge, etc.). The apparatus 102 also includes a sensor section 110, which may comprise a multi-phase flow detector 112.

The apparatus 102 may further comprise to one or more borehole seals 138 to touch the formation 148 and assist in the process of extracting fluid 154 from the formation 148. The apparatus 102 also comprises one or more pumps 106 and one or more fluid paths 116. A sampling sub 114 (e.g., multi-chamber section) with the ability to individually select a fluid storage module 150 to which a fluid sample can be driven may exist between the pumps 106 and the fluid exit 162 from the apparatus 102.

The pressure measurement device 108 and/or sensor section 110 may be located in the fluid path 116 so that saturation pressure can be measured while fluid 154 is pumped through the tool 104. It should be noted that, while the downhole tool 104 is shown as such, some embodiments of the invention may be implemented using a wireline logging tool body. However, for reasons of clarity and economy, and so as not to obscure the various embodiments illustrated, this implementation has not been explicitly shown in this figure.

The apparatus 100 may also include logic 140, perhaps comprising a sampling control system. The logic 140 can be used to acquire seal contact quality data 158, as well as formation fluid property data, including saturation pressure.

The apparatus 102 may include a data acquisition system 152 to couple to the tool 104, and to receive signals 142 and data 160 generated by the pressure measurement device 108 and the sensor section 110, as well as from sensors that may be included in the seals 138. The data acquisition system 152, and/or any of its components, may be located downhole, perhaps in the tool housing or tool body, or at the surface 166, perhaps as part of a computer workstation 156 in a surface logging facility.

In some embodiments of the invention, the downhole apparatus 102 can operate to perform the functions of the workstation 156, and these results can be transmitted to the surface 166 and/or used to directly control the downhole sampling system.

The sensor section 110 may comprise one or more sensors, including a multi-phase flow detector 112 that comprises a densitometer, a bubble point sensor, a compressibility sensor, a speed of sound sensor, an ultrasonic transducer, a viscosity sensor, and/or an optical density sensor. It should be noted that a densitometer is often used herein as one example of a multiphase flow detector 112, but this is for reasons of clarity, and not limitation. That is, the other sensors noted above can be used in place of a densitometer, or in conjunction with it. In any case, the measurement signals 142 provided by the sensor section 110 and data 160 provided by the seal sensors may be used as they are, or smoothed using analog and/or digital methods.

A control algorithm can thus be used to program the processor 130 to detect borehole seal contact quality, perhaps based on the presence of multi-phase fluid flow. The volumetric fluid flow rate of the fluid 154 that enters the seals 138 as commanded by the pump 106 can be reduced from some initial (high) level to maintain a substantially maximum flow rate at which single phase flow can occur. The pump 106 may comprise a unidirectional pump or a bidirectional pump.

When a high initial pumping rate is used, cavitation in the sample may occur, but as the volumetric flow rate is reduced, single-phase flow is achieved, and more efficient sampling occurs. This may operate to lower contamination in the sample, due to an average sampling pressure that is higher than what is provided by other approaches. In some embodiments, this same mechanism can be used with seals 138 having probes of the focused sampling type to determine if the guard ring (surrounding an inner sampling probe) is removing enough fluid to effectively shield the inner probe. A telemetry transmitter 144 may be used to transmit data obtained from the multi-phase flow detector 112 and other sensors in the sensor section 110 and the seals 138 to the processor 130, either downhole, or at the surface 166.

Figure 2:
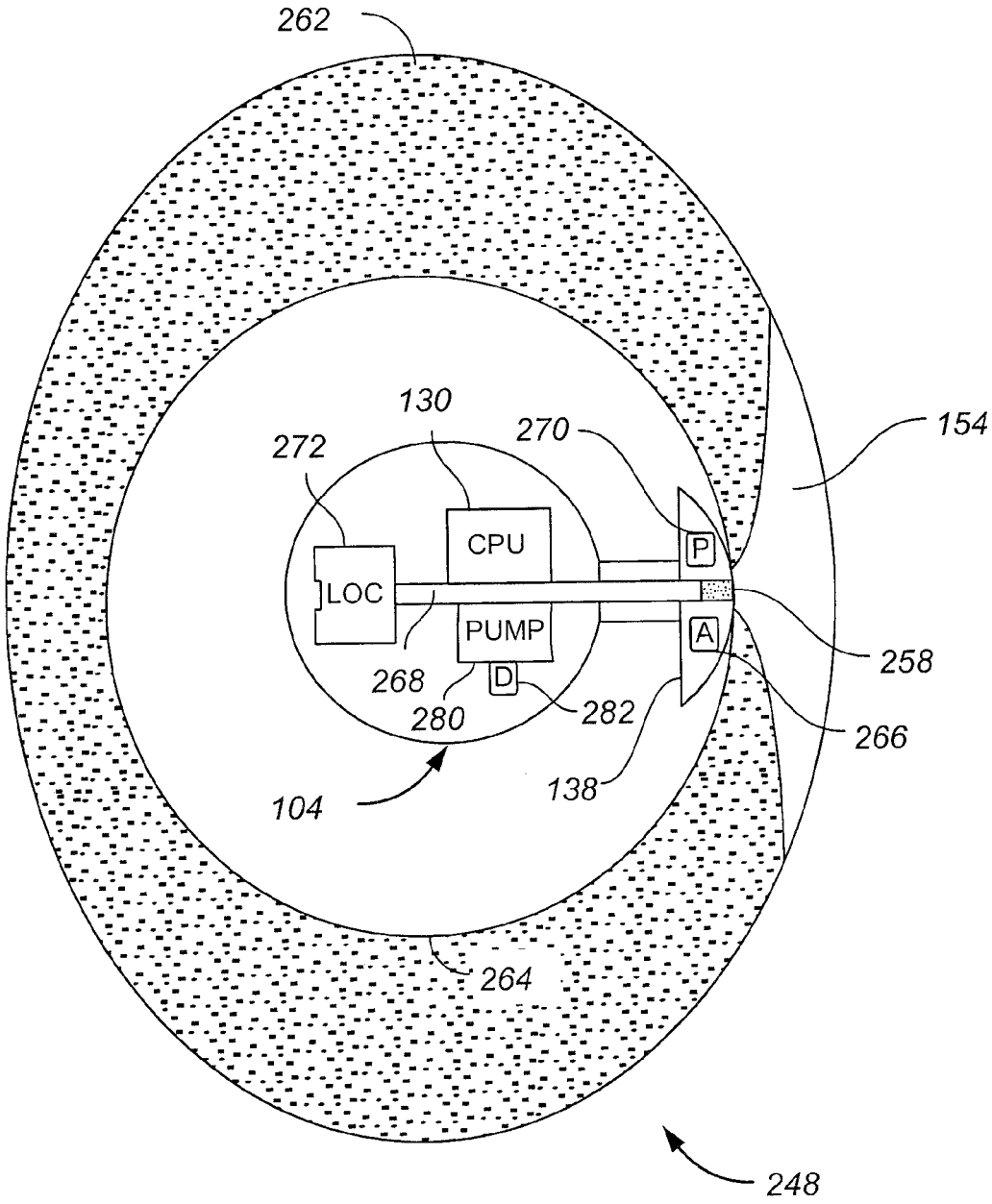
FIG. 2 is a top, cut-away view of the seal-formation interface according to various embodiments of the invention.

FIG. 2 is a top, cut-away view of the seal-formation interface 248 according to various embodiments of the invention. Here a single seal 138 is shown in cross-section. The filtrate 262 surrounding the well bore 264 is pulled into the isolated volume 258 created by the seal 138, and then into the probe 268 by the pump 280, creating a flow field of fluid 154 at the entrance to the seal 138. The fluid 154 flows along the path as a one phase or multi-phase fluid, where its characteristics can be measured by the sensor section 110 (see FIG. 110).

Consider the activity within the isolated volume 258. Interstitial volumes in the formation 148 are filled with the fluid 154. Pumping begins and fluid 154 moves into the isolated volume 258. Flow paths within the tool 104 are large in comparison to the mud-caked surface of the formation 148. The pumping rate can be ramped up until the differential pressure causes the fluid 154 in the reservoir to rupture the cake. This sends some fluid 154 into the tool 104 as well as some fines (e.g., detectable using a densitometer in the tool 104). The pump rate may continue to increase, bringing more fluid 154 in to the tool, until either a preset limit is imposed, or the densitometer output data indicates gas breakout from a liquid (e.g., bubble point) or liquid falls out from a gas (e.g., dew point). Either circumstance can operate to drive the densitometry measurements from indicating single phase smooth behavior to more transitory multi-phase transition behavior.

The isolated volume 258 is a point of relatively high differential pressure as the fluid 154 travels from the formation 148 to the inlet of the pump 280. The pressure wave invading the porous media (e.g., rock) in the formation 148 beyond the seal 138 moves away from the seal 138 as determined by formation geometry, viscosity of the fluid 154, and the pumping rate. A relatively lower differential pressure on the formation fluid 154 is experienced in the isolated volume 258 created by the seal 138, and this volume 258 contains fluid 154 that is actively swept into the probe 268 as the fluid 154 is moved by the pump 280. Once the pumping rate has dropped sufficiently, perhaps below the saturation pressure of the fluid 154, the fluid 154 exhibits an apparent increase in viscosity due to relative permeability effects. The net result is foam generated in the volume 258, which propagates into the tool 104, eventually passing on to the sensor section 110 (see FIG. 1).

The re-conversion of two phase fluid 154 to single phase fluid 154 can be accomplished by a reduction in the volumetric pumping rate. The time for the fluid 154 to actually reach the multi-phase flow detector for phase behavior detection will be driven by the total flow volume in the path plus the volume of the fluid 154 currently located on the suction side of the pump 280.

The appearance and disappearance of two phase flow behavior at the multi-phase flow detector (e.g., densitometer) straddles the saturation pressure of the fluid 154, and the variance about each side of this pressure where fluid 154 is extracted from the formation 148 can be controlled to some extent by adjusting the rate at which the volumetric flow rate is changed (e.g., whether the pumping rate is changed in a linear fashion, or an exponential fashion). However, small changes in the pumping rate may also lengthen the time used to determine the saturation pressure of the fluid 154.

The volumetric pumping rate at the point of phase reconversion pressure is of interest because this turns out to be an efficient pumping rate. That is, a rate which operates to preserve the single phase nature of the fluid 154 while moving the maximum amount of fluid into the tool 104.

The seal 138, which may form part of a formation pad or formation packer, may comprise a variety of components. These include one or more sensors 266 to provide acoustic data (which can include acoustic emission data, if desired), and one or more sensors 270 to provide borehole seal contact pressure data. In some embodiments, a single sensor (266 or 270) may provide both acoustic data and borehole seal contact pressure data. For example, a single piezo transducer used in place of the sensors 266, 270 (i.e., one sensor takes the place of both sensors, so that only a single sensor is used to provide both types of data) might provide a signal having an alternating current (AC) portion as acoustic data, and a direct current (DC) portion as borehole seal contact pressure data (e.g., contact stress). A location mechanism 272 (e.g., a hydraulic or electric actuator) may be used to locate the seal 138 in space with respect to the wall of the borehole 264.

Figure 3:
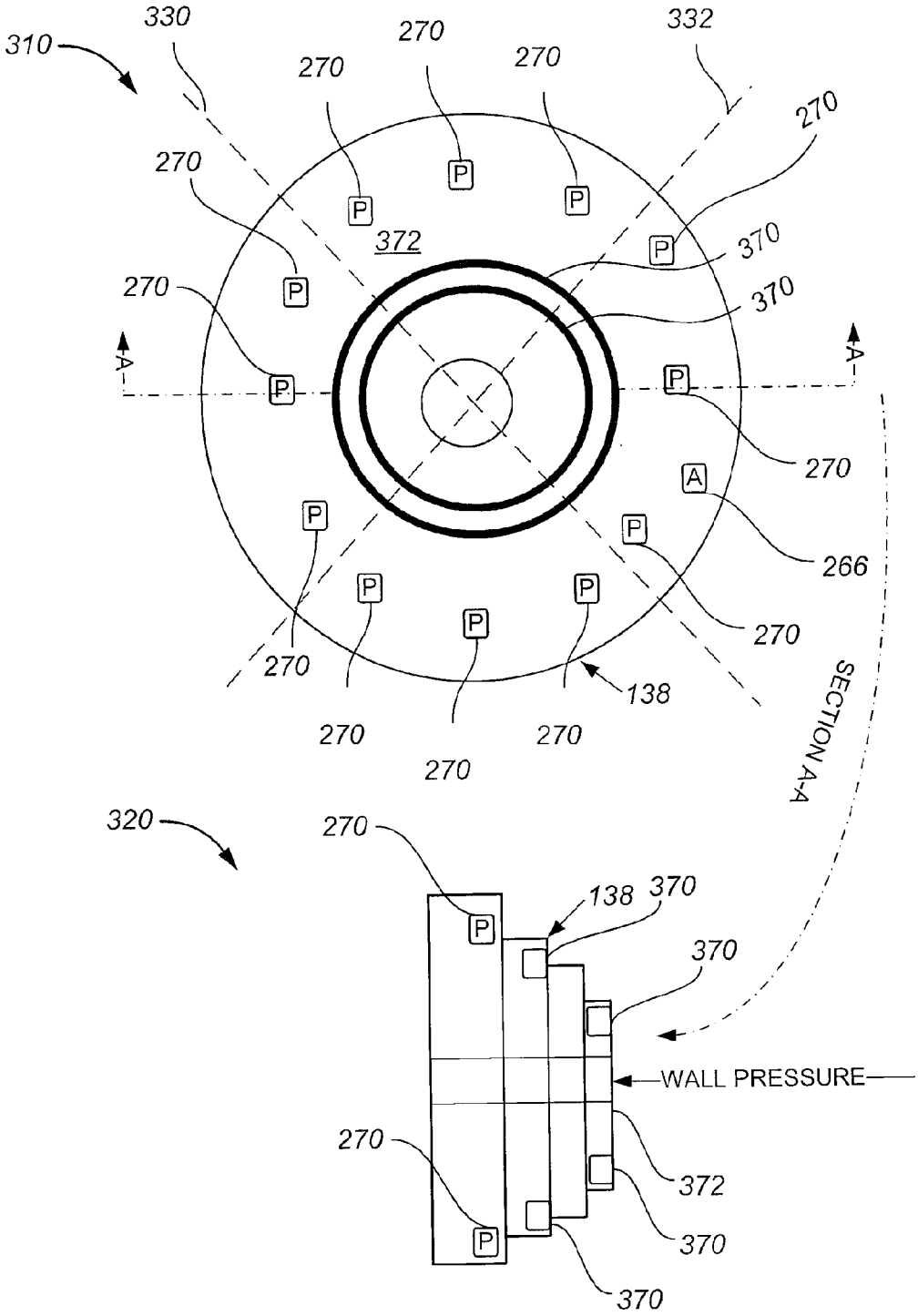
FIG. 3 illustrates frontal and side, cut-away views of a borehole seal according to various embodiments of the invention.

FIG. 3 illustrates frontal 310 and side, cut-away 320 views of a borehole seal 138 according to various embodiments of the invention. Here it can be seen that the seal contact pressure data sensors 270 can take several forms. For example, the sensors 270, 370 as a plurality of separated contact pressure sensors, can take the form of a plurality of spaced apart point contact sensors P or plurality of annular sensors 370 to sense contact pressure on the face 372 of the borehole seal 138. The sensors 270, 370 may comprise strain gauges and/or resistivity sensors, for example.

The face 372 of the seal 138 may comprise a substantially flat or substantially convex surface. However, in some embodiments, the face 372 of the seal 138 may comprise a stepped profile, as shown in the sectional view A-A of FIG. 3.

Thus, referring now to FIGS. 1-3, it can be seen that many embodiments may be realized. For example, an apparatus 102 may comprise one or more borehole seals 138, a location mechanism 272 to locate the borehole seal(s) 138 in space with respect to the wall of the borehole 264, one or more first sensors 270, 370 to provide borehole seal contact pressure data, and one or more second sensors 266 to provide acoustic data. The apparatus 102 may further comprise a processor 130 to adjust operation of the location mechanism 272 based on borehole seal contact quality data comprising borehole seal contact pressure data and the acoustic data.

Contact pressure data can be provided by a number of sensor types. These include one or more strain gauges and/or resistivity sensors. Acoustic data (including acoustic emission data) can be likewise provided by a number of sensor types, such as an ultrasonic sensor, a quartz strain gauge that has a vibration frequency related to the pressure/force on the seal 138, or a resistivity sensor.

One or more sensors 266, 270, 370 can be embedded in the seal 138. Thus, the apparatus 102 may comprise an assembly wherein one or more of the sensors 266, 270, 370 are at least partially embedded in the borehole seal 138. Multiple pressure sensors 270, 370 can be attached to the seal face 372. In some embodiments, as noted previously, a single sensor (e.g., 266, 270, or 370) can be used to provide both acoustic data and borehole seal contact pressure data. Various arrangements of the sensors 266, 270, 370 are contemplated.

Thus, the pressure sensors 270, 370 may comprise a plurality of separated contact pressure sensors to sense contact pressure on a face 372 of the borehole seal 138. Pressure sensors can be arranged as a plurality of annular sensors (e.g., sensors 370) or a plurality of spaced apart point contact sensors (e.g., sensors P).

Electric or hydraulic actuators can be used to move the seal 138 in relation to the wall (inner surface) of the borehole 264. Thus, the location mechanism may comprise an electric drive mechanism and/or a hydraulic drive mechanism.

The apparatus 102 can include a piston, perhaps as part of a pump to pull in fluid, and a sensor to measure the drawdown pressure. Thus, the apparatus 102 may comprise a pump 280 to provide a drawdown pressure within the fluid passage (e.g., the volume 258) through the seal 138. The apparatus 102 may further comprise a sensor 282 to measure the drawdown pressure in the volume 258.

The seal 138 may have an outer face 372 with a stair-step profile (e.g., see Section A-A in FIG. 3). The profile may be formed as a series of concentric rings located farther away from the wall as the diameter of the rings increases. Thus, the outer face 372 of the borehole seal 138 may comprise a stepped profile.

A memory 146 can be used to log borehole seal contact quality data 158. Thus, the apparatus 102 may comprise a memory 146 to store a log history of at least some of the borehole seal contact quality data 158.

Telemetry can be used to supplant, or supplement storage of the borehole seal quality data 158 downhole. Thus, the apparatus 102 may comprise a telemetry transmitter 144 to transmit at least some of the borehole seal contact quality data 158 to the processor 130 (e.g., a processor 130 in a logging facility located at the surface 166). Still further embodiments may be realized.

Figure 4:
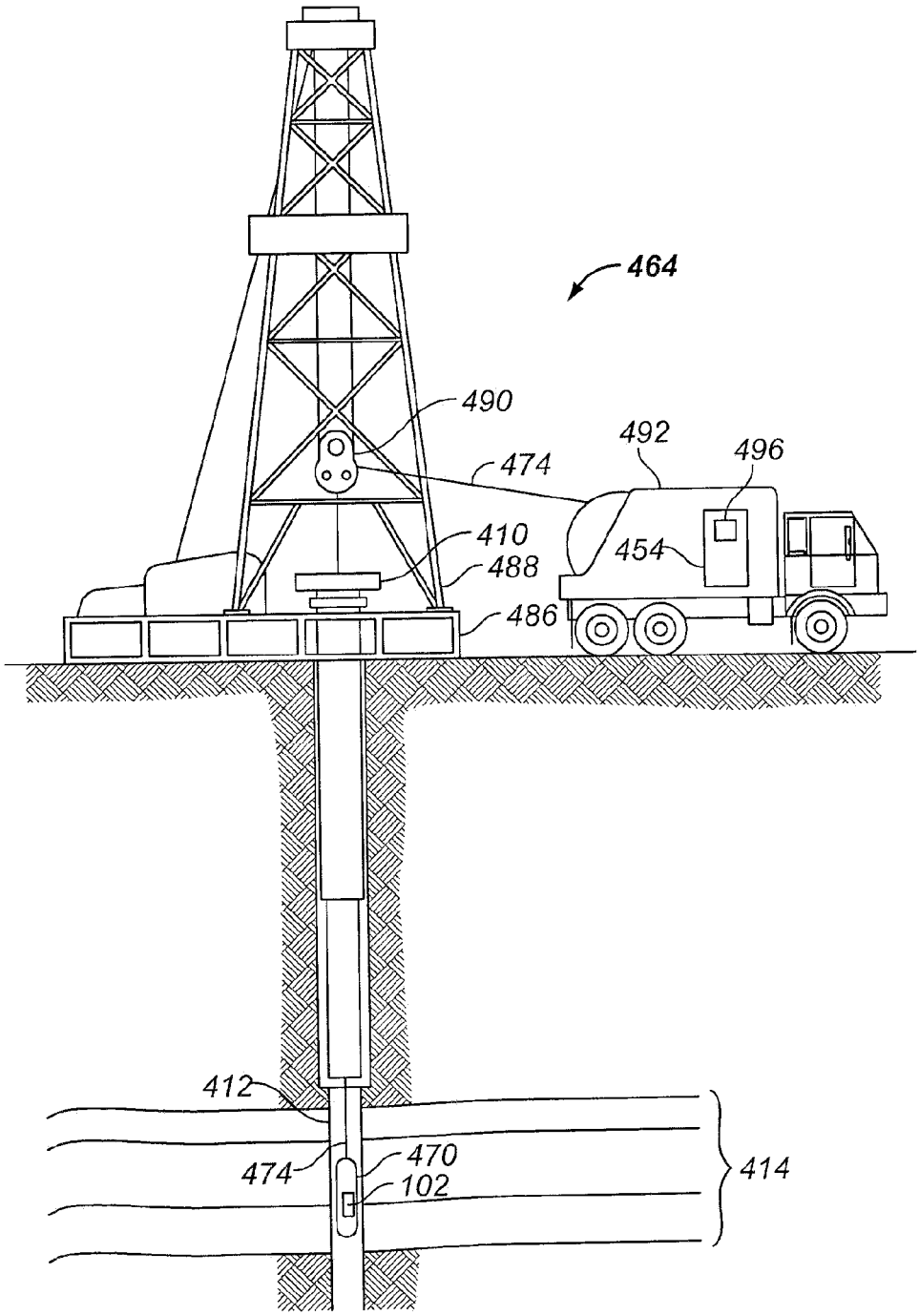
FIG. 4 illustrates a wireline system embodiment of the invention.
Figure 5:
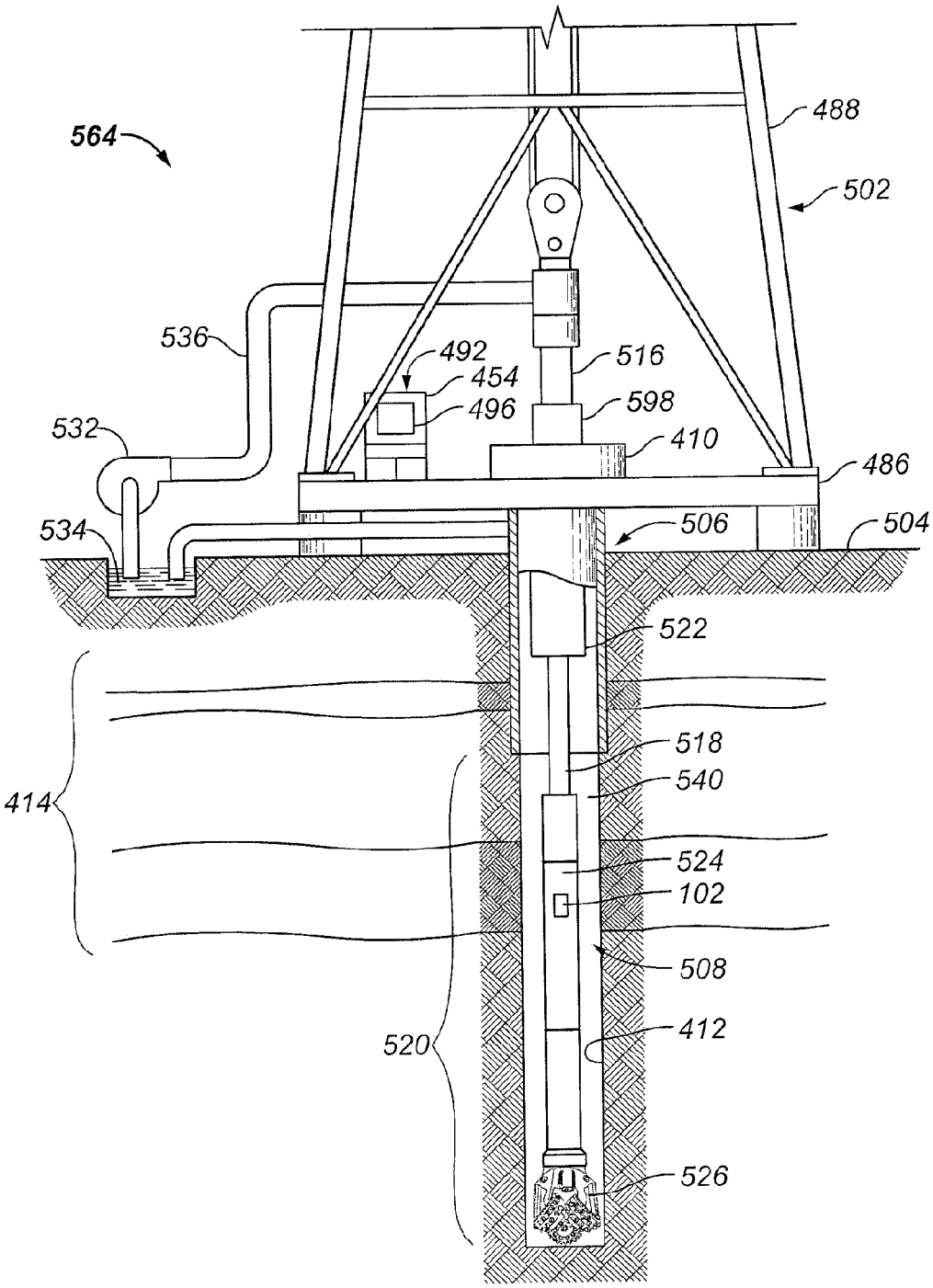
FIG. 5 illustrates a drilling rig system embodiment of the invention.

For example, FIG. 4 illustrates a wireline system 464 embodiment of the invention, and FIG. 5 illustrates a drilling rig system 564 embodiment of the invention. Thus, the systems 100 (see FIG. 1), 464, 564 may comprise portions of a tool body 470 as part of a wireline logging operation, or of a downhole tool 524 as part of a downhole drilling operation.

FIG. 4 shows a well during wireline logging operations. A drilling platform 486 is equipped with a derrick 488 that supports a hoist 490.

The drilling of oil and gas wells is commonly carried out using a string of drill pipes connected together so as to form a drilling string that is lowered through a rotary table 410 into a wellbore or borehole 412. Here it is assumed that the drill string has been temporarily removed from the borehole 412 to allow a wireline logging tool body 470, such as a probe or sonde, to be lowered by wireline or logging cable 474 into the borehole 412. Typically, the tool body 470 is lowered to the bottom of the region of interest and subsequently pulled upward at a substantially constant speed.

During the upward trip, at a series of depths the tool movement can be paused and the tool set to pump fluids into the instruments (e.g., via the seal (s) 138 and the probe 268) included in the tool body 470. Various instruments (e.g., sensors 266, 270, 282, 370; and other instruments shown in FIGS. 1-3) may be used to perform measurements on the subsurface geological formations 414 adjacent the borehole 412 (and the tool body 470). The measurement data can be stored and/or processed downhole (e.g., via subsurface processor(s) 130, logic 140, and memory 146) or communicated to a surface logging facility 492 for storage, processing, and analysis. The logging facility 492 may be provided with electronic equipment for various types of signal processing, which may be implemented by any one or more of the components of the apparatus 102 in FIG. 1. Similar formation evaluation data may be gathered and analyzed during drilling operations (e.g., during logging while drilling (LWD) operations, and by extension, sampling while drilling).

In some embodiments, the tool body 470 comprises a formation testing tool for obtaining and analyzing a fluid sample from a subterranean formation through a wellbore. The formation testing tool is suspended in the wellbore by a wireline cable 474 that connects the tool to a surface control unit (e.g., comprising a workstation 156 in FIG. 1 or 454 in FIGS. 4-5). The formation testing tool may be deployed in the wellbore on coiled tubing, jointed drill pipe, hard-wired drill pipe, or via any other suitable deployment technique.

The apparatus 102 may comprise an elongated, cylindrical body having a control module, a fluid acquisition module, and fluid storage modules. The fluid acquisition module may comprise an extendable fluid admitting probe (e.g., see probe 268 in FIG. 2) and one or more extendable seals 138. Fluid can be drawn into the tool through one or more probes by a fluid pumping unit (e.g., the pump 280). The acquired fluid 154 then flows through one or more fluid measurement modules (e.g., elements 108 and 110 in FIG. 1) so that the fluid can be analyzed using the techniques described herein. Resulting data can be sent to the workstation 454 via the wireline cable 474. The fluid that has been sampled can be stored in the fluid storage modules (e.g., elements 150 in FIG. 1) and retrieved at the surface 166 for further analysis.

Turning now to FIG. 5, it can be seen how a system 564 may also form a portion of a drilling rig 502 located at the surface 504 of a well 506. The drilling rig 502 may provide support for a drill string 508. The drill string 508 may operate to penetrate a rotary table 410 for drilling a borehole 412 through subsurface formations 414. The drill string 508 may include a kelly 516, drill pipe 518, and a bottom hole assembly 520, perhaps located at the lower portion of the drill pipe 518.

The bottom hole assembly 520 may include drill collars 522, a downhole tool 524, and a drill bit 526. The drill bit 526 may operate to create a borehole 412 by penetrating the surface 504 and subsurface formations 414. The downhole tool 524 may comprise any of a number of different types of tools including MWD (measurement while drilling) tools, LWD tools, and others.

During drilling operations, the drill string 508 (perhaps including the kelly 516, the drill pipe 518, and the bottom hole assembly 520) may be rotated by the rotary table 410. In addition to, or alternatively, the bottom hole assembly 520 may also be rotated by a motor (e.g., a mud motor) that is located downhole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 414.

During drilling operations, a mud pump 532 may pump drilling fluid (sometimes known by those of skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 412. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation cuttings created by operating the drill bit 526.

Thus, referring now to FIGS. 1-5, it may be seen that in some embodiments, a system 100, 464, 564 may include a downhole tool 524, and/or a wireline logging tool body 470 to house one or more apparatus 102, similar to or identical to the apparatus 102 described above and illustrated in FIGS. 1-3. Thus, for the purposes of this document, the term "housing" may include any one or more of a downhole tool 104, 524 or a wireline logging tool body 470 (each having an outer wall that can be used to enclose or attach to instrumentation, sensors, fluid sampling devices, pressure measurement devices, seals, seal location mechanisms, processors, and data acquisition systems). The downhole tool 104, 524 may comprise an LWD tool or MWD tool. The tool body 470 may comprise a wireline logging tool, including a probe or sonde, for example, coupled to a logging cable 474. Many embodiments may thus be realized.

For example, in some embodiments, a system 100, 464, 564 may include a display 496 to present the pumping volumetric flow rate, measured saturation pressure, seal pressure, probe pressure, and other information, perhaps in graphic form. A system 100, 464, 564 may also include computation logic, perhaps as part of a surface logging facility 492, or a computer workstation 454, to receive signals from fluid sampling devices, multi-phase flow detectors, pressure measurement devices, probe displacement measurement devices, and other instrumentation to determine adjustments to be made to the seal placement and pump in a fluid sampling device, to determine the quality of the borehole seal contact.

Thus, a system 100, 464, 564 may comprise a downhole tool 104 and one or more apparatus 102 at least partially housed by the downhole tool 104. The apparatus 102 is used to determine the borehole seal contact quality, and may comprise one or more borehole seals, a location mechanism, sensors to provide borehole seal contact pressure data, sensors to provide acoustic data, and one or more processors, as noted previously.

The tool 104 may comprise a wireline tool 470 or an MWD tool 524. The system 100, 464, 564 may further comprise a memory to store a log history of at least some of the borehole seal contact quality data and/or a telemetry transmitter to transmit at least some of the borehole seal contact quality data to the processor(s).

The systems 100, 464, 564; apparatus 102; downhole tool 104; pumps 106, 280; pressure measurement device 108; sensor section 110; multi-phase flow detector 112; sampling sub 114; fluid path 116; processor(s) 130; logic 140; signals 142; transmitter 144; memory 146; fluid storage module 150; data acquisition system 152; fluid 154; computer workstation 156; data 158, 160; fluid exit 162; interface 248; volume 258; filtrate 262; borehole 264; sensors 266, 270, 370, D, P; probe 268; location mechanism 272; face 372; rotary table 410; tool body 470; drilling platform 486; derrick 488; hoist 490; logging facility 492; display 496; drilling rig 502; drill string 508; kelly 516; drill pipe 518; bottom hole assembly 520; drill collars 522; downhole tool 524; drill bit 526; mud pump 532; and hose 536 may all be characterized as "modules" herein. Such modules may include hardware circuitry, and/or a processor and/or memory circuits, software program modules and objects, and/or firmware, and combinations thereof, as desired by the architect of the apparatus 102 and systems 100, 464, 564, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus 102 and systems 100, 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules. Such apparatus and systems may further be included as subcomponents within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
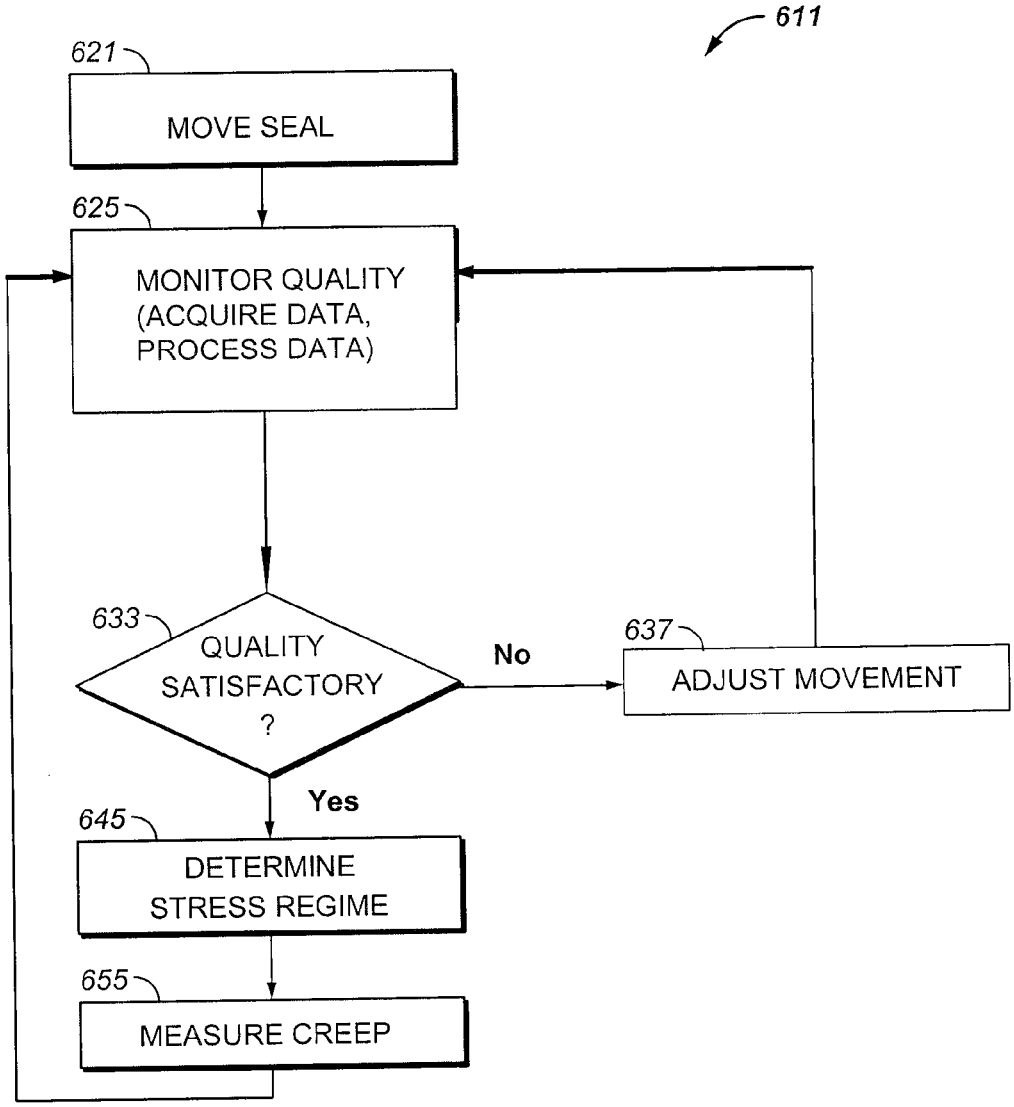
FIG. 6 is a flow chart illustrating several methods according to various embodiments of the invention.

For example, FIG. 6 is a flow chart illustrating several methods 611 of determining borehole seal contact quality, and using the determination to adjust seal location with respect to the borehole wall, according to various embodiments of the invention. Thus, a processor-implemented method 611 to execute on one or more processors that perform the method may begin at block 621 with moving a borehole seal in space with respect to the wall of a borehole while monitoring borehole seal contact quality data. The monitored data may comprise borehole seal contact pressure data and acoustic data (which may include acoustic emission data). If the quality of the borehole seal is judged to be unsatisfactory at block 633, the method 611 may comprise, at block 637, adjusting the movement of the borehole seal based on the borehole seal contact quality data.

As part of monitoring the seal contact quality at block 625, it can be noted that borehole seal contact pressure data may comprise several components. Thus, the borehole seal contact pressure data may comprise borehole seal contact force and/or borehole seal contact area.

As part of monitoring the seal contact quality at block 625, it can be noted that the acoustic data may be digitized and processed. Thus, the activity at block 625 may comprise digitizing the acoustic data to provide digitized acoustic data, and processing the digitized acoustic data in the time and/or frequency domains to determine a measurement of seal quality associated with the borehole seal.

As part of monitoring the seal contact quality at block 625, it can be noted that fluid sampling probe displacement components can be monitored. Thus, the activity at block 625 may comprise monitoring fluid sampling probe displacement data comprising at least one of displacement distance or displacement force.

As part of monitoring seal contact quality at block 625, it can be noted that multiple seal contact pressure measurements can be monitored substantially simultaneously. Thus, the activity at block 625 may comprise monitoring the seal contact pressure data, to include a plurality of separated and substantially simultaneous contact pressure measurements on the face of a borehole seal.

As part of monitoring seal contact quality at block 625, it can be noted that changes in the seal face profile may be detected, perhaps indicating an expected range of pressure, or degradation of the seal quality. For example, if the seal has a stepped profile (see the seal face 372 in FIG. 3), the number of steps that have been compressed may indicate the quality of the seal contact. Thus, the activity at block 625 may comprise determining a change in the borehole seal contact quality data according to changes in the profile of the face of the borehole seal.

In some embodiments, determining whether the quality of the borehole seal contact is satisfactory may include comparing the acoustic data to amplitude profiles. Thus, the activity at block 633 may comprise comparing at least a portion of the acoustic data to a selected amplitude profile of sound.

In some embodiments, determining whether the quality of the borehole seal contact is satisfactory may include comparing the acoustic data to frequency distribution profiles. Thus, the activity at block 633 may comprise comparing at least a portion of the acoustic data to a selected frequency distribution profile of sound.

In some embodiments, determining whether the quality of the borehole seal contact is satisfactory may include determining the existence of cavitation with respect to fluid moving through a passage in the seal, perhaps acoustically, or by other methods. Cavitation may even indicate seal failure. Thus, the activity at block 633 may comprise detecting cavitation of a formation fluid passing through the borehole seal during drawdown pumping activity.

In some embodiments, determining whether the quality of the borehole seal contact is satisfactory may include distinguishing the acoustic data by the degree of modulation detected, perhaps indicating seal failure or degradation. Thus, the activity at block 633 may comprise determining whether the acoustic data provides one of a substantially continuous tone or a substantially modulated tone (i.e., the substantially continuous tone indicating a satisfactory seal, and the substantially modulated tone indicating an unsatisfactory seal).

The borehole seal can be moved to maintain a selected differential pressure within the isolated volume, such as about 110% to about 140%, or approximately 120% to 125% of the difference between the hydrostatic pressure and the drawdown pressure. Thus, the activity of adjusting the movement of the borehole seal at block 637 may comprise maintaining a differential pressure of the borehole seal that is greater than a difference between the hydrostatic pressure of the geologic formation adjacent the borehole wall, minus the drawdown pressure associated with a pump coupled to a fluid path through the borehole seal.

Movement of the borehole seal against the wall of the borehole may be stopped upon determining degradation of seal quality, according to various measurements. Thus, the activity at block 637 may comprise halting movement of the borehole seal based on deterioration in borehole seal quality associated with changes in the borehole seal contact quality data.

If the quality of the borehole seal is judged to be satisfactory at block 633, the method 611 may continue on to block 645 to include determining stress regime information from separated contact pressure measurements. This can be accomplished by using sensors (e.g., sensors P in FIG. 3) deployed in a radial arrangement across the face of the probe, so that the existence of stress tensors along various axes (e.g., axes 330, 332) in FIG. 3) may be determined. For example, as is known to those of ordinary skill in the art, a normal stress regime would be indicated when $S_V>S_H>S_h$. A strike slip stress regime is indicated when $S_H>S_V>S_h$. A reverse stress regime is indicated when $S_H>S_h>S_V$. And an isotropic stress regime is indicated when $S_H=S_h$.

In some embodiments, formation creep can be measured over a range of differential pressures, to characterize the formation in situ, as opposed to characterizing the formation in a laboratory, outside of the downhole environment. Thus, the method 611 may comprise block 655, which includes measuring formation creep at an interface between the borehole seal and the wall during drawdown pumping activity to characterize the formation adjacent the wall over a range of drawdown pressures. Creep may be measured as a function of fluid probe movement while seal actuators and probe actuators are held in place, for example.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 102 and systems 100, 464, 564 may be implemented in a machine-accessible and readable medium that is operational over one or more networks. The networks may be wired, wireless, or a combination of wired and wireless. The apparatus 102 and systems 100, 464, 564 can be used to implement, among other things, the processing associated with the methods 611 of FIG. 6. Modules may comprise hardware, software, and firmware, or any combination of these. Thus, additional embodiments may be realized.

Figure 7:
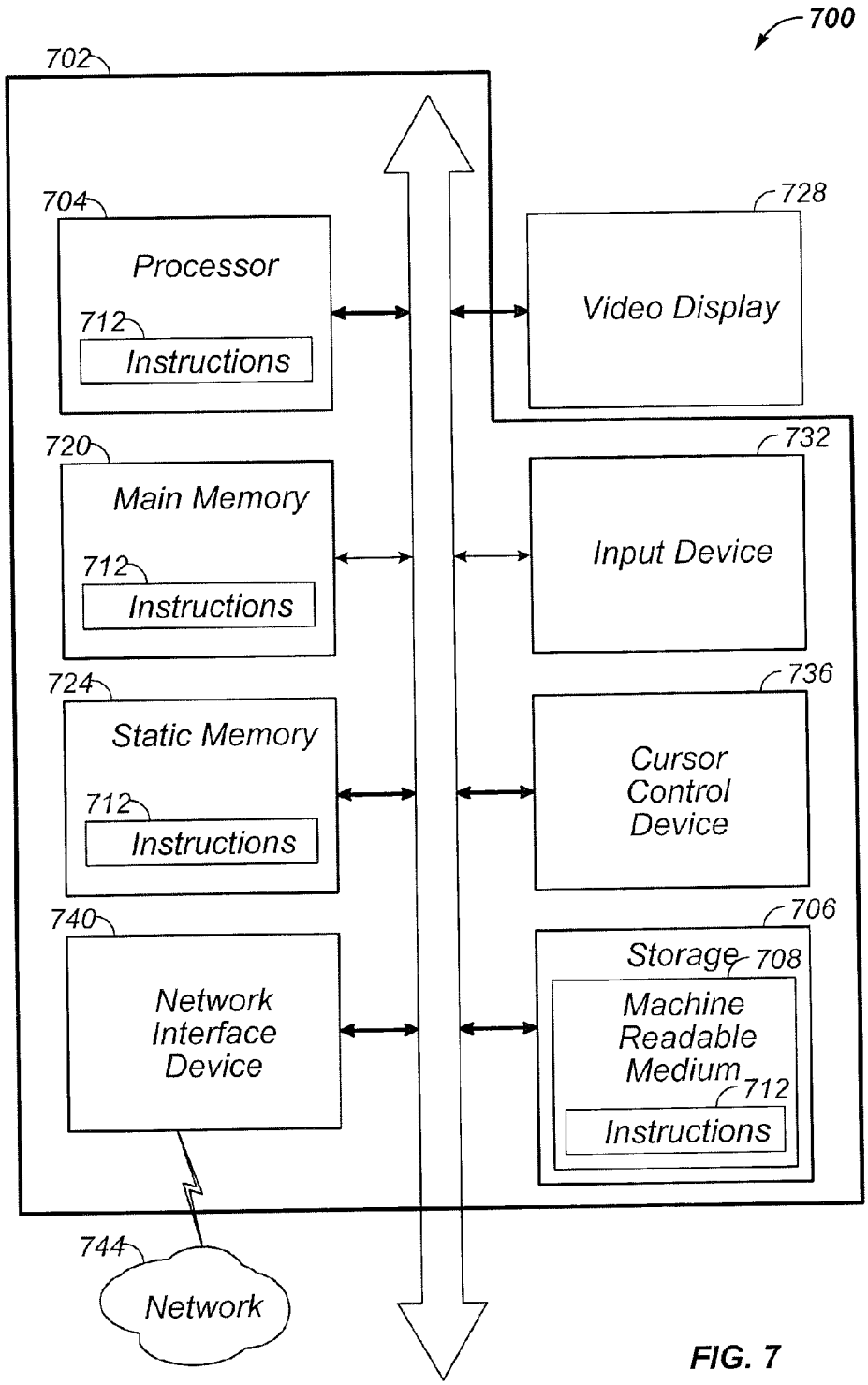
FIG. 7 is a block diagram of an article of manufacture, including a specific machine, according to various embodiments of the invention.

For example, FIG. 7 is a block diagram of an article 700 of manufacture, including a specific machine 702, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 700 of manufacture, such as a computer, a memory system, a magnetic or optical disk, some other storage device, and/or any type of electronic device or system may include one or more processors 704 coupled to a machine-readable medium 708 such as a memory (e.g., removable storage media, as well as any memory including an electrical, optical, or electromagnetic conductor) having instructions 712 stored thereon (e.g., computer program instructions), which when executed by the one or more processors 704 result in the machine 702 performing any of the actions described with respect to the methods above.

The machine 702 may take the form of a specific computer system having a processor 704 coupled to a number of components directly, and/or using a bus 716. Thus, the machine 702 may be incorporated into the apparatus 102 or system 100, 464, 564 shown in FIGS. 1-5, perhaps as part of the processor 130, or the workstation 454.

Turning now to FIG. 7, it can be seen that the components of the machine 702 may include main memory 720, static or non-volatile memory 724, and mass storage 706. Other components coupled to the processor 704 may include an input device 732, such as a keyboard, or a cursor control device 736, such as a mouse. An output device 728, such as a video display, may be located apart from the machine 702 (as shown), or made as an integral part of the machine 702.

A network interface device 740 to couple the processor 704 and other components to a network 744 may also be coupled to the bus 716. The instructions 712 may be transmitted or received over the network 744 via the network interface device 740 utilizing any one of a number of well-known transfer protocols (e.g., HyperText Transfer Protocol). Any of these elements coupled to the bus 716 may be absent, present singly, or present in plural numbers, depending on the specific embodiment to be realized.

The processor 704, the memories 720, 724, and the storage device 706 may each include instructions 712 which, when executed, cause the machine 702 to perform any one or more of the methods described herein. In some embodiments, the machine 702 operates as a standalone device or may be connected (e.g., networked) to other machines. In a networked environment, the machine 702 may operate in the capacity of a server or a client machine in server-client network environment, or as a peer machine in a peer-to-peer (or distributed) network environment.

The machine 702 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 702 is illustrated, the term "machine" shall also be taken to include any collection of machines that individually or jointly execute a set (or multiple sets) of instructions to perform any one or more of the methodologies discussed herein.

While the machine-readable medium 708 is shown as a single medium, the term "machine-readable medium" should be taken to include a single medium or multiple media (e.g., a centralized or distributed database, and/or associated caches and servers, and or a variety of storage media, such as the registers of the processor 704, memories 720, 724, and the storage device 706 that store the one or more sets of instructions 712. The term "machine-readable medium" shall also be taken to include any medium that is capable of storing, encoding or carrying a set of instructions for execution by the machine and that cause the machine 702 to perform any one or more of the methodologies of the present invention, or that is capable of storing, encoding or carrying data structures utilized by or associated with such a set of instructions. The terms "machine-readable medium" or "computer-readable medium" shall accordingly be taken to include tangible media, such as solid-state memories and optical and magnetic media.

Various embodiments may be implemented as a stand-alone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may afford formation evaluation clients the opportunity to more intelligently choose between repeating measurements and moving the tool. Additional data on rock properties that can be collected using various embodiments can inform the selection of future testing locations within the same formation, and wellbore, as well as determining how to adjust the seal/probe setting pressure to enhance sealing and/or prevent rock failure. Acquired data may also indicate a preferential erosion of some part of the well bore (up in a horizontal well or the outside of an arc in a directional well). Real-time or substantially real-time analysis of acoustic and mechanical data can be used as control data for a feedback mechanism that controls the setting of a tool pad, packer, or probe, using enough force to securely drive the pad to the borehole wall, to seal the pad against the wall without rock failure due to over-compression. Finally, monitoring for incipient failure and the acoustic signature of pad leakage can provide a lower average long-term pad sealing force, perhaps extending the service life of pads and packers used on a job.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a borehole seal;

a location mechanism to locate the borehole seal in space with respect to a wall of a borehole;

one or more sensors to provide borehole seal contact pressure data and borehole seal acoustic data; and a processor to adjust operation of the location mechanism based on borehole seal contact quality data comprising the borehole seal contact pressure data and an acoustic signature of pad leakage determined from the acoustic data.

2. The apparatus of claim 1, wherein the one or more sensors include a first sensor comprising:

at least one of a strain gauge or a resistivity sensor.

3. The apparatus of claim 2, wherein the one or more sensors include a second sensor comprising:

at least one of a strain gauge, an acoustic sensor, or an ultrasonic sensor.

4. The apparatus of claim 1, wherein at least one of the one or more sensors is at least partially embedded in the borehole seal.

5. The apparatus of claim 1, wherein the one or more sensors comprise:

a plurality of separated contact pressure sensors to sense contact pressure on a face of the borehole seal.

6. The apparatus of claim 5, wherein the plurality of separated contact pressure sensors comprise:

one of a plurality of annular sensors or a plurality of spaced apart point contact sensors.

7. The apparatus of claim 1, wherein the location mechanism comprises:

at least one of an electric drive mechanism or a hydraulic drive mechanism.

8. The apparatus of claim 1, further comprising:

a pump to provide a drawdown pressure within a fluid passage through the seal; and another sensor to measure the drawdown pressure.

9. The apparatus of claim 1, wherein an outer face of the borehole seal comprises a stepped profile.

10. A system, comprising:

a processor to adjust operation of the location mechanism based on borehole seal contact quality data comprising the borehole seal contact pressure data and the acoustic data;

a downhole tool;

a borehole seal mechanically coupled to the downhole tool;

a location mechanism to locate the borehole seal in space with respect to a wall of a borehole;

one or more sensors to provide borehole seal contact pressure data and borehole seal acoustic data; and a processor to adjust operation of the location mechanism based on borehole seal contact quality data comprising the borehole seal contact pressure data and an acoustic signature of pad leakage determined from the acoustic data.

11. The system of claim 10, wherein the downhole tool comprises one of a wireline tool or a measurement while drilling tool.

12. The system of claim 10, further comprising:

a memory to store a log history of at least some of the borehole seal contact quality data.

13. The system of claim 10, further comprising:

a telemetry transmitter to transmit at least some of the borehole seal contact quality data to the processor.

14. A processor-implemented method to execute on one or more processors that perform the method, comprising:

moving a borehole seal in space with respect to a wall of a borehole while monitoring borehole seal contact quality data comprising borehole seal contact pressure data and an acoustic signature of pad leakage determined from borehole seal acoustic data; and adjusting movement of the borehole seal based on the borehole seal contact quality data.

15. The method of claim 14, wherein the borehole seal contact pressure data comprises borehole seal contact force and/or borehole seal contact area.

16. The method of claim 14, further comprising:

comparing at least a portion of the acoustic data to a selected amplitude profile of sound and/or a selected frequency distribution profile of sound.

17. The method of claim 14, wherein the acoustic data comprises acoustic emission data.

18. The method of claim 14, further comprising:

digitizing the acoustic data to provide digitized acoustic data; and processing the digitized acoustic data in at least one of the time or frequency domains to determine a measurement of seal quality associated with the borehole seal.

19. The method of claim 14, wherein the monitoring further comprises:

monitoring fluid sampling probe displacement data comprising at least one of displacement distance or displacement force.

20. The method of claim 14 wherein the monitoring further comprises:

monitoring the seal contact pressure data including a plurality of separated and substantially simultaneous contact pressure measurements on a face of the borehole seal.

21. The method of claim 20, further comprising:

determining stress regime information from the separated contact pressure measurements.

22. The method of claim 14, wherein the adjusting comprises:

maintaining a differential pressure of the borehole seal that is greater than a difference between a hydrostatic pressure of a geologic formation adjacent the wall minus a drawdown pressure associated with a pump coupled to a fluid path through the borehole seal.

23. The method of claim 14, further comprising:

detecting cavitation of a formation fluid passing through the borehole seal during drawdown pumping activity.

24. The method of claim 14, further comprising:

determining whether the acoustic data provides one of a substantially continuous tone or a substantially modulated tone.

25. A processor-implemented method to execute on one or more processors that perform the method, comprising:

moving a borehole seal in space with respect to a wall of a borehole while monitoring borehole seal contact quality data comprising borehole seal contact pressure data and acoustic data;

adjusting movement of the borehole seal based on the borehole seal contact quality data; and measuring formation creep at an interface between the borehole seal and the wall during drawdown pumping activity to characterize a formation adjacent the wall over a range of drawdown pressures.

26. An article including a non-transitory machine-readable medium having instructions stored therein, wherein the instructions, when executed, result in a machine performing:

moving a borehole seal in space with respect to a wall of a borehole while monitoring borehole seal contact quality data comprising borehole seal contact pressure data and an acoustic signature of pad leakage determined from borehole seal acoustic data; and adjusting movement of the borehole seal based on the borehole seal contact quality data.

27. The article of claim 26, wherein the instructions, when executed, result in the machine performing:

determining a change in the borehole seal contact quality by detecting a change in profile of a face of the borehole seal.

28. The article of claim 26, wherein the instructions, when executed, result in the machine performing:

halting movement of the borehole seal based on deterioration in borehole seal quality associated with changes in the borehole seal contact quality data.

* * * * *

UNITED STATES PATENT AND TRADEMARK OFFICE

CERTIFICATE OF CORRECTION

PATENT NO. : 8,733,163 B2
APPLICATION NO. : 13/700852
DATED : May 27, 2014
INVENTOR(S) : Pelletier et al.

It is certified that error appears in the above-identified patent and that said Letters Patent is hereby corrected as shown below:

On the title page, item [57], line 2, after "method", insert --and--, therefor

Signed and Sealed this
Eleventh Day of November, 2014

Michelle K. Lee

Michelle K. Lee
*Deputy Director of the United States Patent and Trademark Office*